US008371486B2

(12) United States Patent
Imafuku et al.

(10) Patent No.: US 8,371,486 B2
(45) Date of Patent: Feb. 12, 2013

(54) HOLDER FOR PORTABLE DEVICE

(75) Inventors: Kyoko Imafuku, Tokyo (JP); Satoshi Mochizuki, Machida (JP)

(73) Assignee: K-Work Planning Co., Ltd., Tokyo (JP)

( * ) Notice: Subject to any disclaimer, the term of this patent is extended or adjusted under 35 U.S.C. 154(b) by 546 days.

(21) Appl. No.: 12/665,096

(22) PCT Filed: Sep. 11, 2008

(86) PCT No.: PCT/JP2008/066390
§ 371 (c)(1),
(2), (4) Date: Dec. 17, 2009

(87) PCT Pub. No.: WO2009/035023
PCT Pub. Date: Mar. 19, 2009

(65) Prior Publication Data

US 2010/0181352 A1 Jul. 22, 2010

(30) Foreign Application Priority Data

Sep. 14, 2007 (JP) ..... 2007-239358

(51) Int. Cl.
*B65H 75/40* (2006.01)
*A45C 13/30* (2006.01)

(52) U.S. Cl. ..... 224/162; 224/258; 16/405; 16/429

(58) Field of Classification Search ..... 224/162, 224/268, 217, 258; 150/107, 108; 16/113.1, 16/114.1, 405
See application file for complete search history.

(56) References Cited

U.S. PATENT DOCUMENTS

| | | | | | |
|---|---|---|---|---|---|
| 2,441,902 | A * | 5/1948 | Powell | 224/258 |
| 2,769,475 | A * | 11/1956 | Fisher | 190/115 |
| 3,198,300 | A * | 8/1965 | Tuttle | 16/405 |
| 5,027,874 | A * | 7/1991 | Gazzola | 150/108 |
| 5,294,029 | A * | 3/1994 | Shimura et al. | 224/162 |
| 5,971,238 | A * | 10/1999 | Malvasi et al. | 224/148.6 |
| 6,053,381 | A * | 4/2000 | Fahl et al. | 224/153 |
| 6,112,357 | A * | 9/2000 | Halloran | 15/106 |
| 6,536,078 | B2 * | 3/2003 | Tsai | 16/114.1 |
| 7,458,488 | B2 * | 12/2008 | Bass et al. | 224/162 |
| 2005/0051586 | A1 * | 3/2005 | Siwak et al. | 224/576 |
| 2005/0061844 | A1 * | 3/2005 | Haro | 224/639 |

FOREIGN PATENT DOCUMENTS

| | | | |
|---|---|---|---|
| JP | 09-299128 | A | 11/1997 |
| JP | 2001-053845 | A | 2/2001 |
| JP | 2005-177064 | A | 7/2005 |
| JP | 2006-081130 | A | 3/2006 |

* cited by examiner

*Primary Examiner* — Nathan J Newhouse
*Assistant Examiner* — Todd Anderson
(74) *Attorney, Agent, or Firm* — Sughrue Mion, PLLC

(57) ABSTRACT

A holder (1) adapted for use for a portable device and having a windable strap. The holder (1) includes a case body (4) having an upper case (3) and a lower case (2); the strap (10); a strap winding drum (20) for winding the strap (10) on it; a drive spring (30) for applying bias in the direction of winding the strap to the strap winding drum (20); strap openings (50), each functioning as the entrance and exit for the strap (10); and a fixation mechanism (40) for controlling a mechanism for receiving the strap (10). To pull out the strap (10), a user places one finger on a slope member (51) of the upper case (3), places another finger on the rear side of the strap (10), and pulls out the strap (10). Even if the strap is frequently pulled out, the strap does not have a permanent set.

14 Claims, 7 Drawing Sheets

HOLDER FOR PORTABLE DEVICE

TECHNICAL FIELD

The present invention relates to an art for a holder for a portable device having a strap used for hanging a portable small-sized device from a shoulder, a neck, a wrist or the like. In particular, it relates to an art taking into account operability of a strap opening of the strap.

BACKGROUND ART

There has been known a holder for a portable device that is able to be hung from a neck of a user by attaching a tape-like strap to a part of a portable electronic device such as a digital camera or a cell phone, an ID card such as a company ID card used in the company or a security card, or the like, when the user carries the portable electronic device, the ID card or the like.

As an art related to this holder for the portable device, a holder for a portable device is disclosed which has a strap whose length is adjustable by automatically winding up the strap with biasing force of a spring of a strap winding drum inside the holder for the portable device (for example, refer to patent literature 1).

Patent Literature 1: Japanese Patent Application Laid Open Publication No. 9-299128

DISCLOSURE OF THE INVENTION

Problems To Be Solved By the Invention

With use of FIG. 6, a problem of the holder for the portable device described in patent literature 1 will be explained.

In a holder 100 for the portable device described in patent literature 1, there is a problem that a strap 10 has a "permanent set" when the strap 10 is pulled out.

In order that a user may pull out the strap 10, the strap 10 is picked up with two fingers (such as a thumb and an index finger), and then the strap 10 is necessary to be pulled out from the inside of the holder 100 for the portable device. If the holder 100 is repeatedly used in the above-described manner, a fold caused by picking up the strap 10 with the fingers remains on the strap 10, and therefore the strap 10 has the "permanent set." This permanent set causes a lack of strength at a part of the strap 10, and thereby a problem such as cutting of the strap 10 at the part occurs. As a result, the holder 100 for the portable device ends its lifetime.

As an improvement action against this, change of the material of the strap to another material having durability may be considered. However, if the material thereof is changed to another material with high strength, the thickness of the strap becomes larger. As a result, shapes of the strap winding drum and a main body of the holder for the portable device are necessary to be drastically changed.

Accordingly, there has been desired a new holder for a portable device having a strap difficult to have a "permanent set" even if the strap is frequently pulled out, without drastic change in an external shape of the holder for the portable device and the like.

An object of the present invention is to provide a holder for a portable device having a strap difficult to have a "permanent set" even if the strap is frequently pulled out, without drastic change in an external shape of the holder for the portable device and the like.

Means For Solving the Problems

The present invention includes a holder for a portable device including: a case body that is formed of an upper case and a lower case; a strap that is contained in the case body; a strap winding drum that is rotatably provided to the case body in order to wind up the strap; a drive spring that is attached to an inside of the strap winding drum and that applies bias in a winding-up direction of the strap winding drum; strap openings that are each an entrance and an exit for the strap, and are formed by overlapping ends of the upper case and the lower case with each other; and a fixation mechanism for fixing the strap when the strap is extended or shortened.

The upper case includes, on a side where the strap openings are provided, a slope member that is to support one finger when the strap is pulled out, and both ends of the strap are led into the case body from the respective strap openings, and attached to the strap winding drum, and the strap is wound up on the strap winding drum.

(Explanation of Words)

The "holder for the portable device" is used for carrying a digital camera, a cell phone, an ID card such as a company ID card, a security card or the like when a user goes out. For example, a neck-strap type holder hung from a neck to be used, a shoulder type holder hung from a shoulder, and a hand-strap type holder hung from a wrist are exemplified.

The "fixation mechanism" is incorporated in the case body, and is a member formed into a button or the like.

(Operation)

At the time of using the holder for the portable device, following operation is done.

First, in order to pull out the strap contained in the case body, the strap being out of the strap openings is picked up. At this time, one finger (for example, a thumb) is placed on the slope member. Then, another finger (for example, an index finger) is hooked on and along a rear side of the strap, and the strap is pulled out in a pulling-out direction with keeping the above position.

That is, since the thumb is supported on the surface of the slope member, a finger with which the strap is picked up is only the index finger. Accordingly, the strap is difficult to have a "permanent set" in comparison with a case where the strap is picked up with two fingers. By this operation, durability for a frequent operation of pulling out the strap is improved.

The present invention restricts the holder for the portable device.

Specifically, the slope member is arranged so as to allow the strap to be pulled out in a state of placing a thumb on a surface of the slope member and placing a pad of an index finger on a rear side of the strap when the strap is pulled out.

(Operation)

In order to pull out the strap, the thumb is placed on the slope member, and the strap is pulled out by picking up the rear side of the strap with the index finger. That is, since the thumb is supported on the surface of the slope member, a finger with which the strap is picked up is only the index finger. Accordingly, the strap is difficult to have a "permanent set" occurring at the time of picking up the strap, and therefore the durability of the strap is improved. Note that, in the present invention, although the thumb is supported on the slope member while the index finger is hooked on the rear side of the strap to pull out the strap, fingers used here are not limited to these fingers. This is because a combination of the fingers depends on a user of the holder for the portable device, and the combination thereof includes a thumb and a middle finger, a thumb and a fourth finger, a thumb and a pinky finger, an index finger and a middle finger, an index finger and a fourth finger, an index finger and a pinky finger, and the like.

The present invention restricts the holder for the portable device with a locking member.

Specifically, the locking member is detachable from and attachable to the case body is provided.

(Operation)

The holder for the portable device is used with a cell phone, a digital camera, an ID card or the like attached to the locking member. In addition, the locking member is attachable and detachable, and thus it is easy to be replaced when it is deteriorated by abrasion or the like.

The present invention restricts the holder for the portable device with a fixing mechanism.

Specifically, the fixation mechanism is formed on approximately the same plane as a surface of the upper case, and a surface of the fixation mechanism at a central part is formed into a raised shape.

(Operation)

If the surface of the upper case and the upper surface of the fixation mechanism are formed on the same plane, appearance thereof is enhanced when seen in the horizontal direction. In particular, since the entire form is rounded, the unity in the design is obtained.

In addition, the surface of the fixation mechanism is a raised shape at the central part thereof. The reason is as follows. If the fixation mechanism is projected from the surface of the upper case, a neck of a user may be wrung in some cases by shortening the strap when the fixation mechanism is pushed in error by an erroneous operation of the user. In other words, this shape takes into account an "easy push" and "safety" of the fixation mechanism.

The invention restricts the holder for the portable device with a fixing mechanism.

Specifically, the fixation mechanism is formed so as to project from a surface of the upper case.

(Operation)

The fixation mechanism is necessary to be pushed when the strap is contained. At this time, if the fixation mechanism is projected from the surface of the upper case, it is easy to be pushed. Accordingly, the operability at the time of containing the strap is improved.

Note that, an unintentional push of the fixation mechanism due to the projection of the fixation mechanism may be preventable if a stopper function or the like for stopping the extension of the strap is installed.

The invention is a holder for a portable device including: a case body that is formed of an upper case and a lower case and that has two communication holes at a side wall, the two communication holes communicating an inside and an outside; a strap that is ring-shaped, that passes through the two communication holes of the case body, and that encloses the side wall of the case body between the two communication holes; a drum that is contained in the case body, that is rotatably provided to the case body, that has the strap attached thereto, and that winds up the strap; a drive spring that is attached to an inside of the drum, and that applies bias in a winding-up direction of the drum; and a slope member that spreads from an upper surface of any one of the upper case and the lower case toward the other one of the upper case and the lower case, and that spreads to an exterior of the side wall between the two communication holes of the case body.

The invention restricts the holder for the portable device.

Specifically, the communication holes are each formed into a rectangle having a long side in a direction of an axis serving as a rotation center of the drum, and the slope member tapers, in the direction of the axis, from the upper surface of any one of the upper case and the lower case to approximately a center of the long side of each of the communication holes.

The invention restricts the holder for the portable device.

Specifically, the strap is positioned along the slope member in a state of being wound up by the drum.

The holder for the portable device further includes a button for fixing the strap when the strap is extended or shortened, the button being formed so that a surface thereof is located on approximately the same plane as a surface of the one of the upper case and the lower case, or so that the surface thereof is projected from the surface of the one of the upper case and the lower case.

The case body may be formed by being subjected to mirror finishing.

(Operation)

The case body is subjected to the mirror finishing without painting. This enhances the appearance thereof, and contributes to an environmental conservation.

A scale may be applied to the strap.

(Operation)

The scale is applied to the strap. Thus, convenience for a user is increased since the strap is also used as a measure.

ADVANTAGES OF THE INVENTION

According to the exemplary embodiments provided herewith, it possible to provide a holder for a portable device having a strap difficult to have a "permanent set" even if the strap is frequently pulled out, without drastic change in an external shape of the holder for the portable device and the like.

BEST MODES FOR CARRYING OUT THE INVENTION

Hereinafter, a description will be given of exemplary embodiments of the present invention with reference to the accompanying drawings. The drawings used herein are FIGS. 1 to 7.

FIG. 1 is a perspective view showing an entire configuration of a reel strap (holder for a portable device) 1. FIG. 2A is a front view of strap openings of the reel strap, and FIG. 2B is a back view of the reel strap. FIG. 3A is a left-side view of the reel strap, and FIG. 3B is a right-side view of the reel strap. FIG. 4 is a cross sectional side view of the reel strap. FIGS. 5A and 5B are perspective views showing states of a strap of the reel strap 1 when the strap is pulled out. FIGS. 6A and 6B are perspective views showing states of a strap when the strap is pulled out from a conventional reel strap. FIG. 7 is a plain view and a cross sectional view showing another exemplary embodiment of the reel strap.

(First Exemplary Embodiment)

As shown in FIGS. 2A, 2B and 4, the reel strap 1 includes: a case body 4 having a lower case 2 and an upper case 3 fitted with the lower case 2; a strap 10 contained in the case body 4; a strap winding drum 20 rotatably provided to the case body 4 in order to wind up the strap 10; a drive spring 30 that is attached inside the strap winding drum 20, and that applies bias in the direction of winding up the strap 10 to the strap winding drum 20; strap openings 50, each serving as the entrance and exit for the strap 10, which are formed by overlapping respective ends of the upper case 3 and the lower case 2 with each other; and a button 40 (fixation mechanism) for fixing the strap 10 at the time of extending or shortening the strap 10.

The size of the reel strap 1 in the first exemplary embodiment is 36.5 mm in width (of the case body 4) and 104 mm in length (from the case body 4 to a locking member 5). Note that, the present invention is not limited to these dimensions as a matter of course.

At a side where the strap openings 50 are provided, the upper case 3 is provided with a slope member 51 that can support one finger when the strap 10 is pulled out. The slope member 51 has a tapered shape, tapering from a proximal end thereof located on an upper side of the upper case 3 toward a distal end thereof located at an outer edge of the upper case 3 (see FIGS. 1, 3A, and 3B. Both ends of the strap 10 are led into the case body 4 from the respective strap openings 50, and attached to the strap winding drum 20, and then the strap 10 is wound up on the strap winding drum 20.

In addition, as shown in FIG. 1, the locking member 5 connectable to a digital camera, a cell phone, an ID card or the like is provided on a back side of the lower case 2 and the upper case 3.

The case body 4 is formed of two members, that is, the upper case 3 and the lower case 2. The lower case 2 and the upper case 3 have the periphery thereof integrally welded by an ultrasound. Since mirror finishing is performed on a molding cavity surface of the case body 4, the case body 4 enhances the external appearance without coating.

The strap winding drum 20 is rotatably provided to the case body 4, and has a step portion coaxially formed with an axis 6, around the center of the upper case 3 and the lower case 2, as an axis.

The locking member 5 is used with a cell phone, a digital camera, an ID card or the like attached thereto. The locking member 5 is attachable and detachable, and thus it is easily replaced if the locking member 5 is deteriorated by overweight, abrasion, or the like. Note that, the shape of the locking member 5 is an example, and can be changed to another one.

The material of the strap 10 is a fabric made of polyester in the first exemplary embodiment. Note that, another material including synthetic resin such as Nylon, Tetron, polyethylene or the like is usable. In the first exemplary embodiment, a material having 1050 mm in length, 5 mm in width and 0.45 mm in thickness is used.

The strap 10 is processed by ultrasonic machining so as to be formed into a ring. The connecting portion of this strap 10 is entered inside the strap winding drum 20 and is wound on the strap winding drum 20 so as to be doubly overlapped with each other. The other end of the strap 10 is drawn into the case body 4 from the strap openings 50 of the case body 4, and is attached to the strap winding drum 20. The strap winding drum 20 has two cut-outs, and the strap 10 is fixed on these cut-outs. Such a configuration is basically the same as that of a tape measure.

The strap 10 is wounded on the strap winding drum 20, and thus the drive spring 30 stores biasing force when the strap 10 is pulled out from the strap openings 50.

While the button 40 is pushed, the strap 10 is in a state of releasing. In other words, the strap 10 is pulled out to a desired length with the button 40 pushed, and then the strap 10 is fixed by releasing the button 40. The strap 10 that has been pulled out can be used as a neck strap or the like for a cell phone or an ID card attached to the locking member 5.

The drive spring 30 has one end attached to a groove formed in the axis 6 and the other end attached to the inside of the strap winding drum 20.

Note that, the dimension of the drive spring 30 according to the first exemplary embodiment is set to have the thickness of 0.10 mm times the width of about 4 mm. By setting the dimension of the drive spring 30 to have the thickness of 0.10 mm times the width of about 4 mm, the capacity of containing the strap 10 is improved in comparison with a drive spring having the smaller width than that (for example, 3 mm), and thus the stability is increased.

The button 40 is formed into a substantially rectangular parallelpiped shape, and the upper surface of the button 40 is formed on approximately the same plane as the surface of an upper surface portion 3*a* of the upper case 3. As described above, forming the upper surface portion 3*a* of the upper case 3 and the upper surface of the button 40 on the same plane enhances the appearance when the reel strap 1 is seen in the horizontal direction. In particular, it is preferable in that the whole form is rounded and the unity in the design is obtained.

In addition, if the button 40 is projected from the surface of the upper case 3, a neck of a user may be wrung in some cases by shortening the strap 10 when the button 40 is pushed in error by an erroneous operation of the user. For this reason, the button 40 has such a design that the button 40 is not projected from the surface of the upper case 3.

However, from a standpoint of "easy push" of the button 40, this configuration makes the button 40 difficult to be pushed. To avoid this, the surface of the button 40 is a raised shape at the central part.

By forming the button 40 in such a way, the edge of the upper case 3 and the rising apex of the button 40 are placed on the same plane, and thereby the button 40 cannot be unintentionally pushed, and moreover easily pushed.

When the button 40 is pushed to release the strap having been in a fixed state, the strap 10 is automatically wound up in the strap winding drum 20 by the stored force of the drive spring 30, and is contained in the case.

As shown in FIGS. 2A and 2B, the strap openings 50 are formed by the lower case 2 and the upper case 3 fitted with each other.

The strap 10 is to slide from the strap openings 50 so as to be freely extended or shortened. The strap openings 50 has the slope member 51 formed thereon. The slope member has a slope from the upper surface portion 3*a* of the upper case 3 toward directions in which the strap openings 50 are formed.

The slope member 51 has a function to prevent the strap 10 from having a permanent set, with one finger placed onto the slope member 51 when the strap 10 is pulled out with a finger.

(Comparison with Conventional Art)

With reference to FIGS. 5A to 6B, operation of the reel strap 1 will be described.

First, operation for pulling out the strap in the conventional reel strap will be described. As shown in FIG. 6A, when the strap 10 of the reel strap 100 is pulled out, the strap 10 is picked up with two fingers, that is, a thumb and an index finger.

Then, as shown in FIG. 6B, the strap 10 is pulled out while being picked up with the two fingers. By such operation, when the reel strap is repeatedly used, abrasion due to the picking up with the two fingers occurs, and the strap 10 itself has a "permanent set". Thereby, a lifetime of the strap 10 is shortened because the strap 10 is easily cut, for example.

By contrast, as shown in FIG. 5A, in the reel strap 1 according to the present invention, firstly, the strap 10 being out of the strap openings 50 is picked up in order to pull out the strap 10 contained in the case body. At this time, the thumb is placed on the slope member 51. Then, as shown in FIG. 5B, the index finger is hooked on and along a rear side 10*a* of the strap 10, and the strap 10 is pulled out in a pulling-out direction with keeping the above position.

That is, since the thumb is supported on the surface of the slope member 51, a finger with which the strap is picked up is only the index finger. Thus, the strap 10 is difficult to have a "permanent set" in comparison with a case where the strap 10 is picked up with the two fingers. Therefore, durability for the frequent operation of pulling out the strap 10 is improved.

Moreover, this product is developed without changing a material of the strap 10 to a different material having durability. Therefore, the thickness of the strap 10 and the shape of the strap winding drum 20 are not necessary to be changed, and thus the shape of the reel strap 1 is not necessary to be drastically changed.

Note that, in FIGS. 5A to 6B, the main part (reel strap 1) is illustrated on a larger scale in comparison with the fingers shown in the same drawings for convenience of explanation. Thus, the illustration is different from the actual proportion.

(Second Exemplary Embodiment)

In FIG. 7, another exemplary embodiment of the reel strap 1 is shown. In the reel strap 1, since the shape of a button is different from that of the button 40, this button is denoted by 40B. Specifically, the button 40B is formed so as to project from the surface of the upper surface portion 3*a* of the upper case 3. The button 40B is necessary to be pushed when the strap 10 is contained. At this time, if the button is projected from the upper surface portion 3*a* of the upper case 3, it is easy to be pushed. By this configuration, the operability at the time of containing the strap 10 is improved.

Note that, an unintentional push of the button 40B due to the projection of the button 40B may be preventable if a configuration in which a stopper function or the like is additionally installed is provided. Here, the stopper function stops the extension of the strap 10.

In the exemplary embodiments, the thumb is supported on the slope member 51 while the index finger is hooked on the rear side 10*a* of the strap 10 to pull out the strap. However, the configuration is not limited to this. This is because a combination of the fingers depends on a user of the reel strap 1. The combination of the fingers is for example, a thumb and a middle finger, a thumb and a fourth finger, a thumb and a pinky finger, an index finger and a middle finger, an index finger and a fourth finger, an index finger and a pinky finger, or the like.

By printing on the case body (particularly, the upper surface portion 3*a*), it can be used as an advertising medium, for example. The effectiveness is high since it receives more exposure than general promotion items.

In addition, if a scale at regular intervals is printed on the strap 10, it can be also used as a measure. Instead of the scale, for example, it can be an advertisement with printing of a company name, or an identity of the company member.

Industrial Applicability

The present invention can be used in a manufacturing industry, a selling business, and an advertising industry using a holder for a portable device as an advertising medium.

DESCRIPTION OF REFERENCE NUMERALS AND SIGNS

Figure 1:
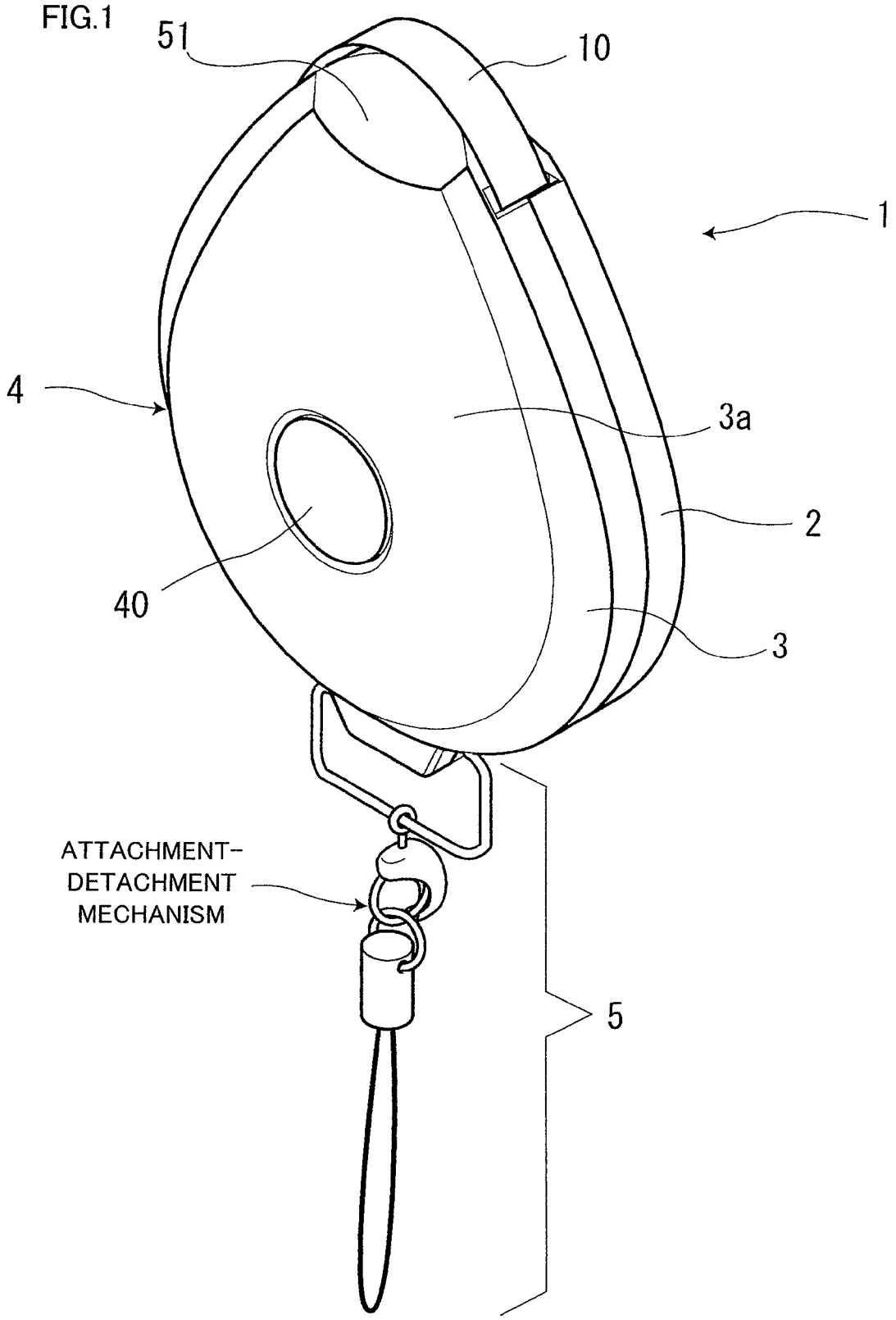
FIG. 1 is a perspective view showing an entire configuration of a reel strap.
Figure 2A:
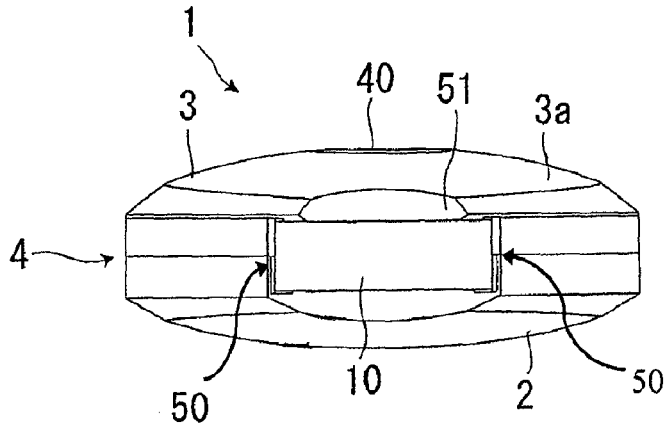
FIG. 2A is a front view of strap openings.
Figure 2B:
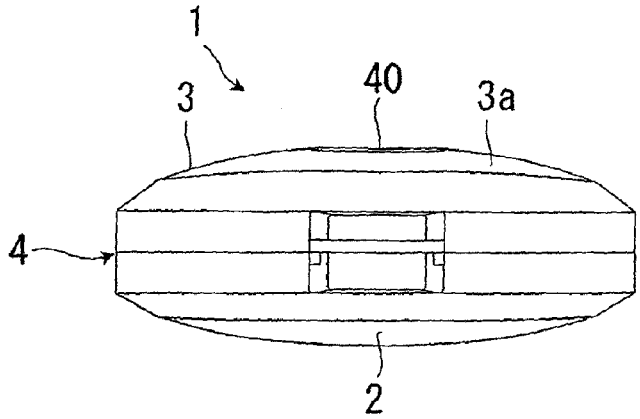
FIG. 2B is a back view of the reel strap.
Figure 3A:
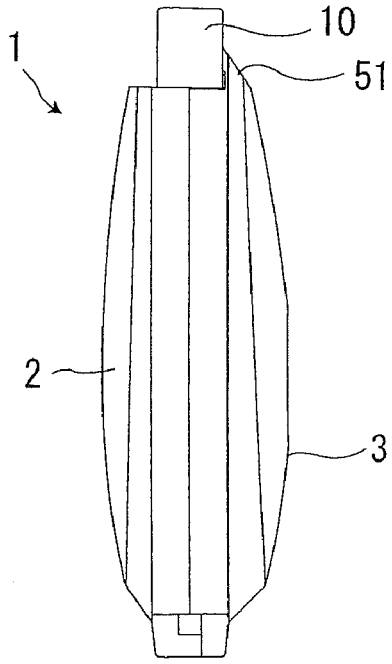
FIG. 3A is a left-side view of the reel strap.
Figure 3B:
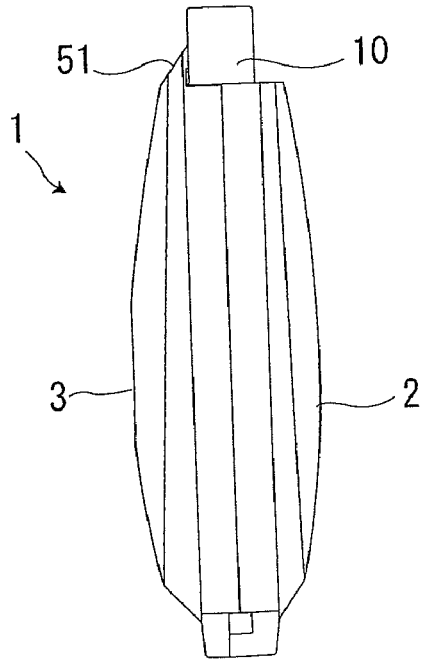
FIG. 3B is a right-side view of the reel strap.
Figure 4:
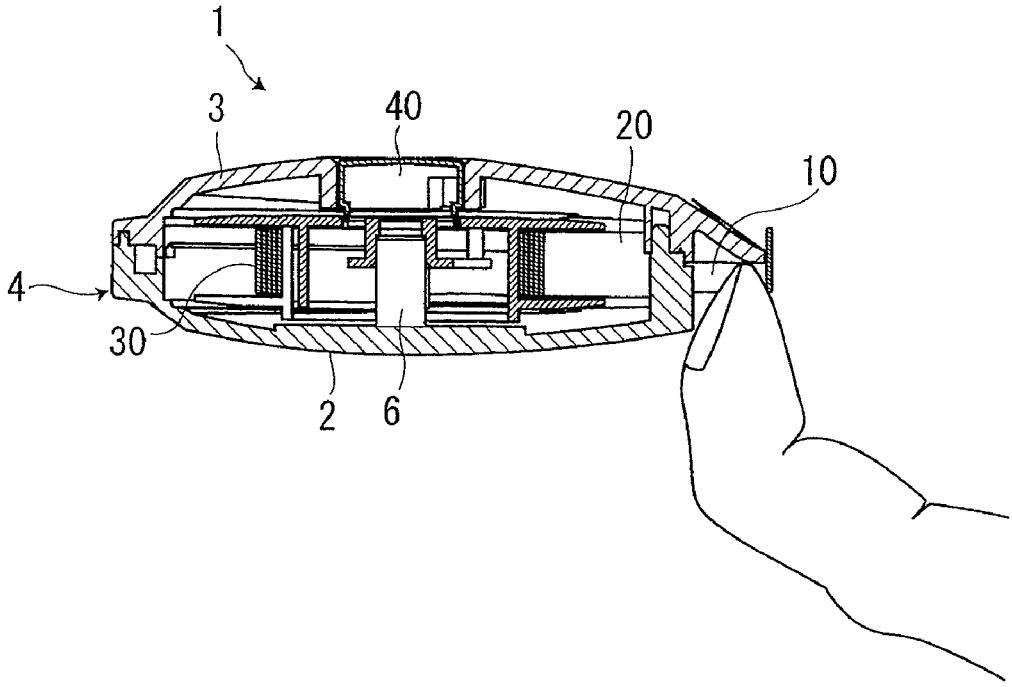
FIG. 4 is a cross sectional side view of the reel strap.
Figure 5A:
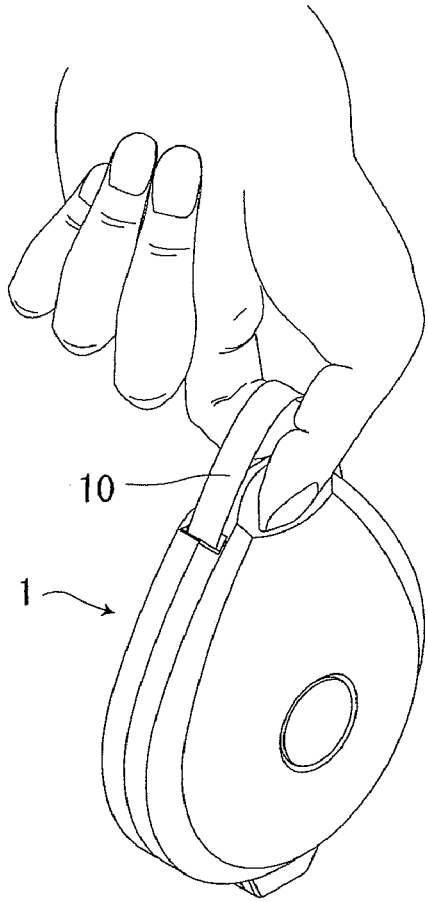
FIGS. 5A and 5B are perspective views showing states of a strap of the reel strap when the strap is pulled out.
Figure 5B:
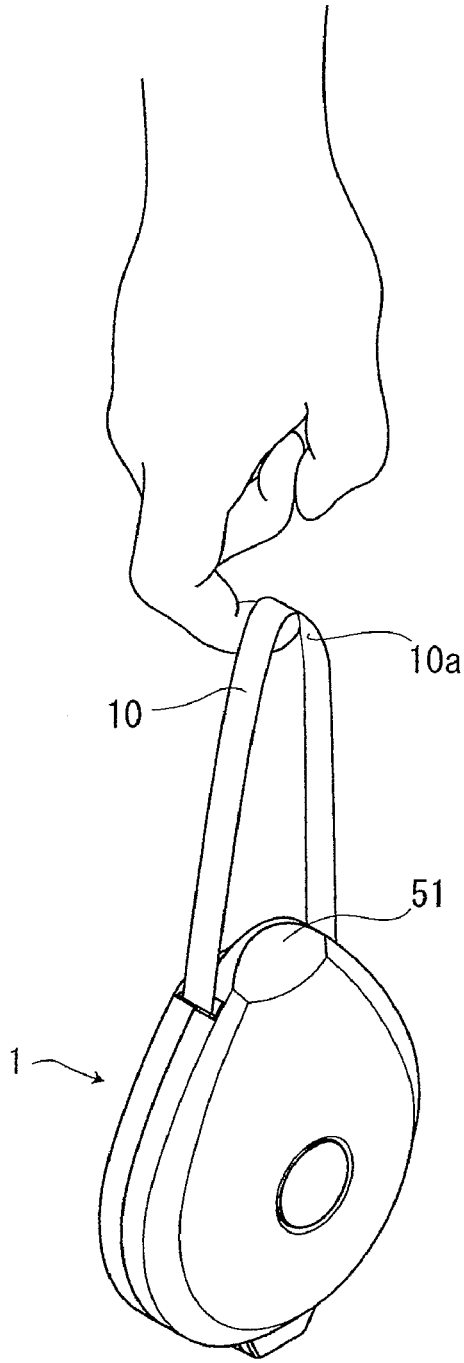
Figure 6A:
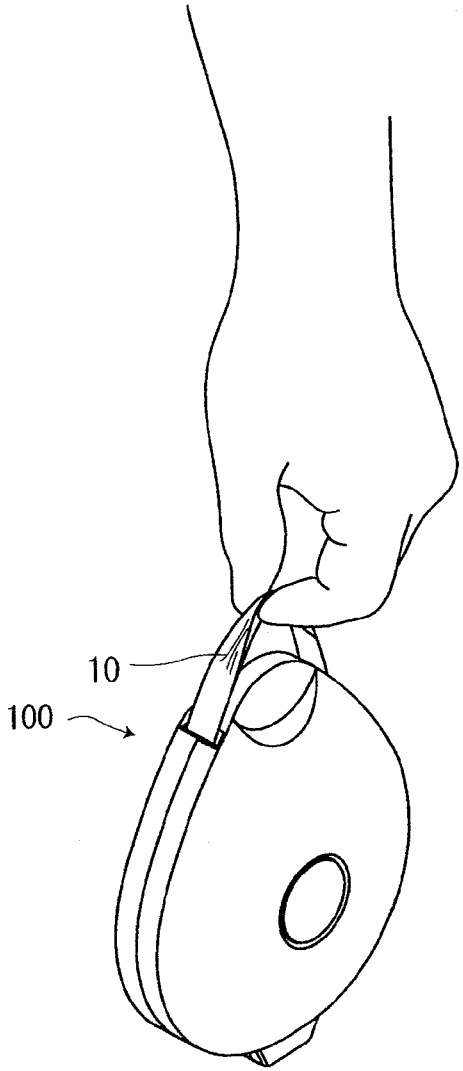
FIGS. 6A and 6B are perspective views showing states of a strap when the strap is pulled out from a conventional reel strap.
Figure 6B:
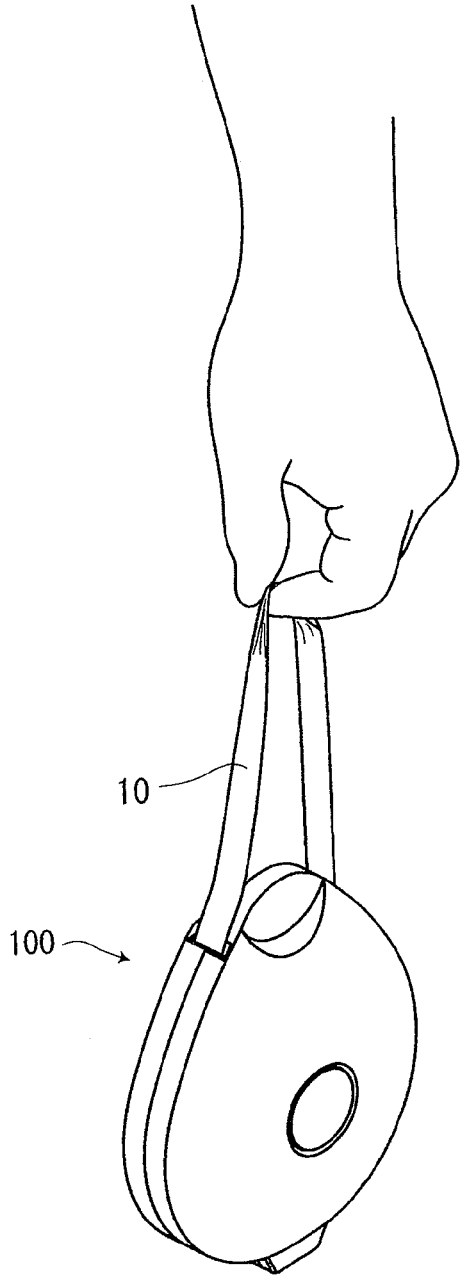
Figure 7:
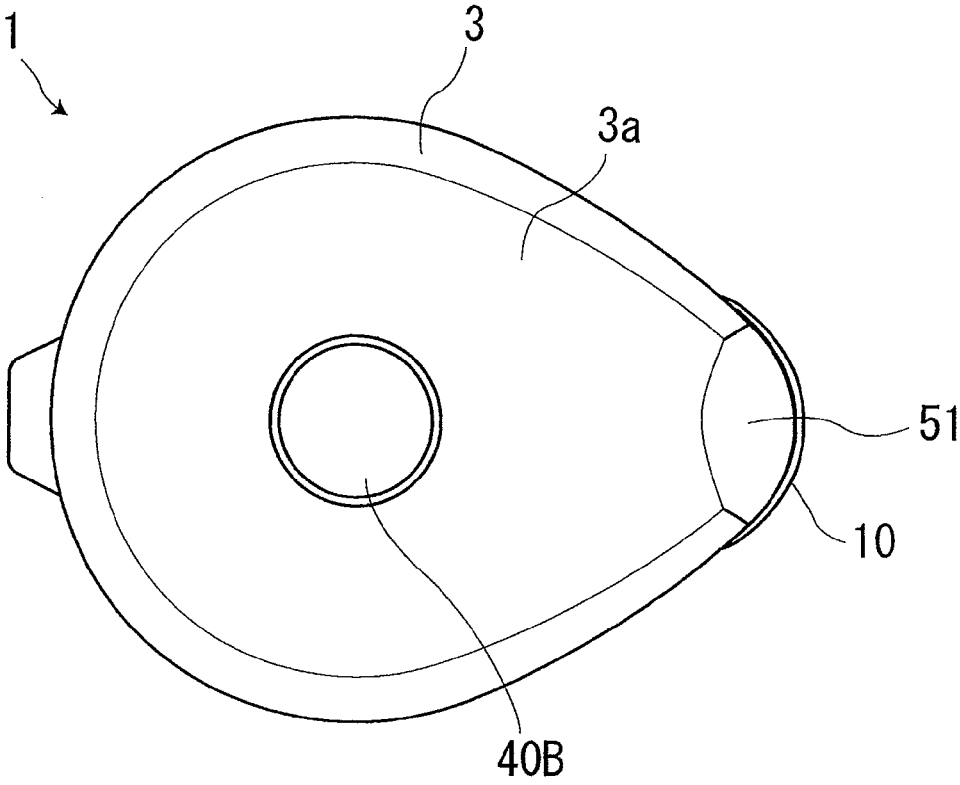
FIG. 7 is a plain view and a cross sectional view showing another exemplary embodiment of the reel strap.
Figure 7:
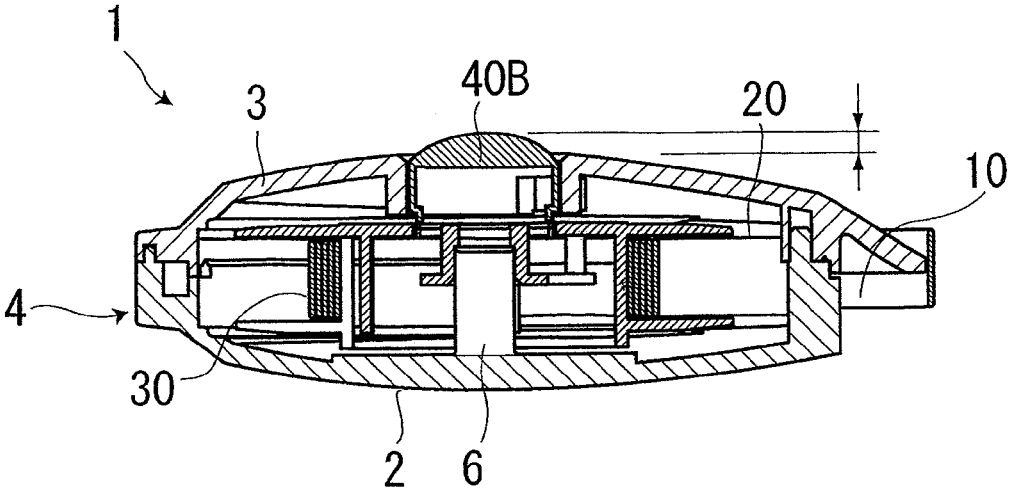

1, 100 . . . reel strap,
2 . . . lower case,
3 . . . upper case,
3*a* . . . upper surface portion
4 . . . case body,
5 . . . locking member,
6 . . . axis,
10 . . . strap,
10*a* . . . rear side of strap,
20 . . . strap winding drum,
30 . . . drive spring,
40, 40B . . . button,
50 . . . strap openings, and
51 . . . slope member

The invention claimed is:

1. A holder for a portable device comprising:

a case body that is formed of an upper case and a lower case, each having a side wall to define a perimeter and having two communication holes in the side wall of the upper and lower case, the two communication holes communicating an inside and an outside;

a strap that is ring-shaped, that passes through the two communication holes of the case body, and that encloses the side wall of the case body between the two communication holes;

a drum that is contained in the case body, that is rotatably provided to the case body, that has the strap attached thereto, and that winds up the strap;

a drive spring that is attached to an inside of the drum, and that applies bias in a winding-up direction of the drum; and a slope member that slants from an outside surface of any one of the upper case and the lower case toward the other one of the upper case and the lower case, and that extends from a center portion of the side wall located between the two communication holes of said one of the upper case and lower case, wherein the slope member located between the two communication holes of the case body is formed in a continuous curve.

2. The holder for the portable device according to claim 1, wherein the communication holes are each formed into a rectangle having a long side in a direction of an axis serving as a rotation center of the drum, and the slope member extends, in the direction of the axis, from the upper surface of any one of the upper case and the lower case to approximately a center of the long side of each of the communication holes.

3. The holder for the portable device according to claim 1, wherein the strap is positioned along the slope member in a state of being wound up by the drum.

4. The holder for the portable device according to claim 1, further comprising a button for fixing the strap when the strap is extended or shortened, the button being formed so that a surface thereof is located on approximately the same plane as a surface of the one of the upper case and the lower case, or so that the surface thereof is projected from the surface of the one of the upper case and the lower case.

5. The holder for the portable device according to claim 1, wherein the case body is formed by being subjected to mirror finishing.

6. The holder for the portable device according to claim 1, wherein a scale is applied to the strap.

7. A holder for a portable device comprising:

a case body that is formed of an upper case and a lower case, each having a perimeter with the perimeters of the upper and lower cases mating;

a strap that is contained in the case body;

a strap winding drum that is rotatably provided to the case body in order to wind up the strap;

a drive spring that is attached to an inside of the strap winding drum and that applies bias in a winding-up direction of the strap winding drum;

strap openings that are each an entrance and an exit for the strap, and are formed by overlapping ends of the upper case and the lower case with each other; and a fixation mechanism for fixing the strap when the strap is extended or shortened, wherein the upper case includes a slope member extending outwardly from the perimeter of the upper case and between the strap openings, the slope member having a slanted surface from the upper case perimeter to a distal end creating a cavity such that the slope member supports one finger when the strap is pulled out and prevents the finger from passing entirely through the cavity; and both ends of the strap are led into the case body from the respective strap openings, and attached to the strap winding drum, and the strap is wound up on the strap winding drum.

8. The holder for the portable device according to claim 7, wherein the slope member is arranged so as to allow the strap to be pulled out in a state of placing a thumb on a surface of the slope member and placing a pad of an index finger on a rear side of the strap when the strap is pulled out.

9. The holder for the portable device according to claim 7, wherein a locking member that is detachable from and attachable to the case body is provided.

10. The holder for the portable device according to claim 7, wherein the fixation mechanism is formed on approximately the same plane as a surface of the upper case, and a surface of the fixation mechanism at a central part is formed into a raised shape.

11. The holder for the portable device according to claim 7, wherein the fixation mechanism is formed so as to project from a surface of the upper case.

12. The holder for the portable device according to claim 7, wherein the case body is formed by being subjected to mirror finishing.

13. The holder for the portable device according to claim 7, wherein a scale is applied to the strap.

14. The holder for the portable device according to claim 7, wherein the strap winding drum is disposed inside an interior chamber formed by the upper case and lower case, rotatable about an axis that extends through a center area of the upper case and the lower case.

* * * * *